US006501299B2

(12) United States Patent
Kim et al.

(10) Patent No.: US 6,501,299 B2
(45) Date of Patent: Dec. 31, 2002

(54) CURRENT MIRROR TYPE BANDGAP REFERENCE VOLTAGE GENERATOR

(75) Inventors: Young Hee Kim, Kyoungki-do (KR); Jong Doo Joo, Kyoungki-do (KR)

(73) Assignee: Hynix Semiconductor Inc., Ichon-shi (KR)

( * ) Notice: Subject to any disclaimer, the term of this patent is extended or adjusted under 35 U.S.C. 154(b) by 0 days.

(21) Appl. No.: 10/020,575

(22) Filed: Dec. 18, 2001

(65) Prior Publication Data

US 2002/0125938 A1 Sep. 12, 2002

(30) Foreign Application Priority Data

Dec. 27, 2000 (KR) ..... 00-82543

(51) Int. Cl.[7] ..... G05F 1/10; G05F 3/02

(52) U.S. Cl. ..... 326/83; 326/32; 327/539; 323/313

(58) Field of Search ..... 326/82, 83, 32; 327/538, 539, 540, 541, 542, 543; 323/312, 313, 315

(56) References Cited

U.S. PATENT DOCUMENTS 5,936,392 A * 8/1999 Taylor ..... 323/315

* cited by examiner

*Primary Examiner*—Daniel D. Chang
(74) *Attorney, Agent, or Firm*—Jacobson Holman PLLC

(57) ABSTRACT

A current mirror type bandgap reference voltage generator which can reduce variations of a reference voltage due to temperature variations, by separately generating a current proportional to an emitter-base voltage and a current proportional to a thermal voltage, and which also can reduce variations of the reference voltage due to variations of a power voltage, by using a current mirror. The current mirror type bandgap reference voltage generator includes: a first current generator for generating a first current proportional to the emitter-base voltage; a second current generator for generating a second current proportional to the thermal voltage; and a reference voltage generator for adding the first and second currents, and generating a constant reference voltage regardless of variations of the temperature and the power voltage. As a result, the constant voltage is generated regardless of variations of the temperature and the power voltage.

20 Claims, 2 Drawing Sheets

CURRENT MIRROR TYPE BANDGAP REFERENCE VOLTAGE GENERATOR

BACKGROUND OF THE INVENTION

1. Field of the Invention

The present invention relates to a current mirror type bandgap reference voltage generator, and in particular to an improved current mirror type bandgap reference voltage generator which is suitable for generating a constant reference voltage regardless of variations in temperature and power voltage, by making use of a current mirror having a large output resistance and a large swing width.

2. Description of the Background Art

In general, a reference voltage generator includes a reference voltage generator using a MOS transistor having a threshold voltage, and a bandgap reference voltage generator using a bipolar transistor. A CMOS bandgap reference voltage generator is discussed in IEEE Journal of Solid-State Circuit, Vol. 34, No. 5, May 1999, entitled by 'A CMOS Bandgap Reference Circuit with Sub-1-V Operation'.

In a conventional reference voltage generator, the reference voltage changes due to variations of a power voltage VDD, a temperature and a threshold voltage of a MOS transistor. Accordingly, when the power voltage VDD, the temperature and the threshold voltage of the MOS transistor are varied, the conventional reference voltage generator is not normally operated, thereby causing a mis-operation.

A conventional bandgap reference voltage generator using a differential amplifier will now be explained with reference to FIG. 1.

The conventional bandgap reference voltage generator performs a normal operation only when the voltage of a node Va is greater than '$V_{DSAT.MN23}+V_{TN.MN22+DSAT.MN22}$' in an actual DRAM process. But, since the voltage of the node Va is smaller than '$V_{DSAT.MN23}+V_{TN.MN22+DSAT.MN22}$', the bandgap reference voltage generator cannot be normally operated. Here, '$V_{DSAT.MN23}$' is a drain voltage of an NMOS transistor MN23 in a saturated region, '$V_{TN.MN22}$' is a threshold voltage of an NMOS transistor MN22, and $V_{DSAT.MN22}$ is a drain voltage of an NMOS transistor MN22 in a saturated region.

In addition, the conventional bandgap reference voltage generator using the differential amplifier has a minimum operation voltage VDDmin over 1.4V. Thus, it is not suitable for the DRAM having a low voltage tendency.

Although not illustrated, the conventional reference voltage generator has a disadvantage in that the reference voltage has a variation ratio of 0.44% in a period where the power voltage is 2.5V and the temperature ranges from 20 to 90° C., and has a high variation ratio of 0.91% in a period where the power voltage ranges from 2.25V to 2.75V and the temperature is 25° C. As a result, the conventional reference voltage generator cannot be relied upon to operate stably.

SUMMARY OF THE INVENTION

Accordingly, it is a primary object of the present invention to reduce variations of a reference voltage due to variations of a power voltage, by using a current mirror.

Another object of the present invention is to reduce variations of the reference voltage due to temperature variations, by separately generating a current proportional to an emitter-base voltage and a current proportional to a thermal voltage.

Still another object of the present invention is to reduce a minimum operation voltage of a bandgap reference voltage generator by using a current mirror.

In order to achieve the above-described objects of the invention, there is provided a current mirror type bandgap reference voltage generator. A first current generator generates a first current proportional to a base-emitter voltage. A second current generator generates a second current proportional to a thermal voltage. A reference voltage generator adds the first and second currents, and generates a constant reference voltage regardless of variations in temperature and power voltage. Here, the first current generator includes a first current mirror for receiving the power voltage, generating and outputting the first current to a plurality of output terminals. The second current generator includes a second current mirror for receiving the power voltage, generating and outputting the second current to the plurality of output terminals.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

A current mirror type bandgap reference voltage generator in accordance with a preferred embodiment of the present invention will now be described in detail with reference to the accompanying drawings.

Figure 1:
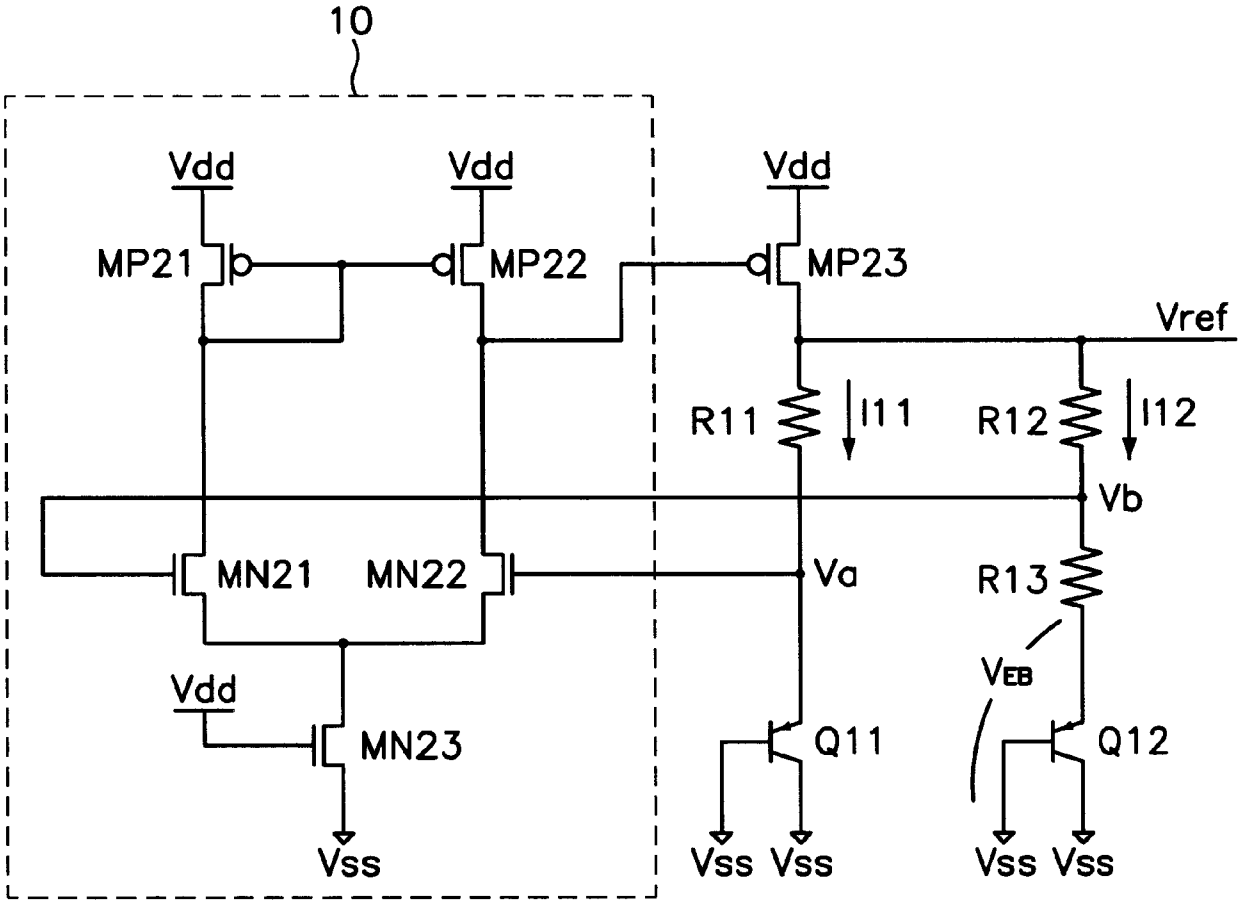
Fig.1 (Prior Art)
FIG. 1 is a circuit diagram illustrating a conventional bandgap reference voltage generator using a differential amplifier.
Figure 2:
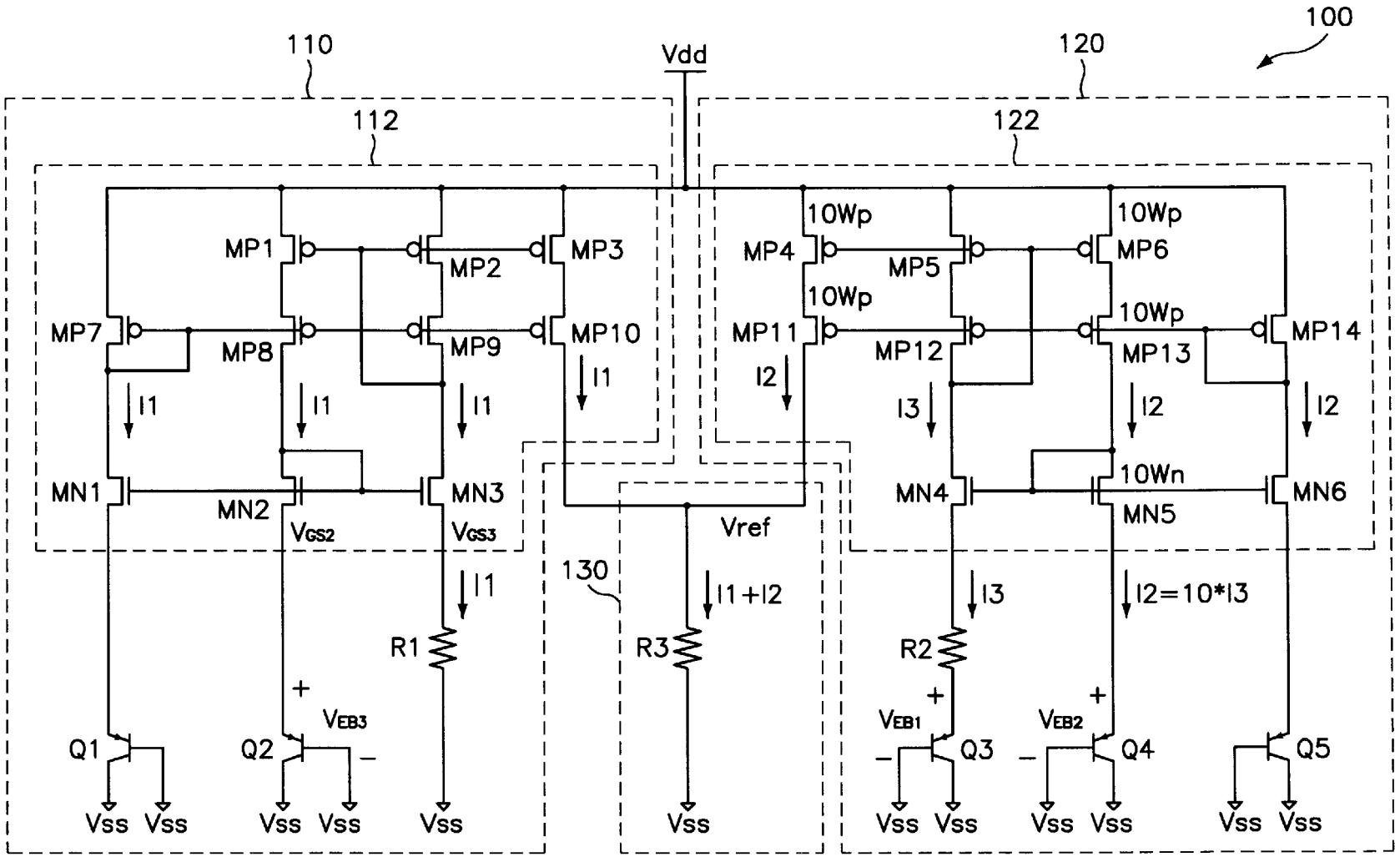
FIG. 2 is a circuit diagram illustrating a current mirror type bandgap reference voltage generator in accordance with a preferred embodiment of the present invention.

FIG. 2 is a circuit diagram illustrating the current mirror type bandgap reference voltage generator including a first current generator 110, a second current generator 120 and a reference voltage generator 130.

The first current generator 110 generates a first current I1 proportional to a base-emitter voltage $V_{EB3}$ of a forwardly biased PNP type bipolar transistor Q2. The second current generator 120 generates a second current I2 proportional to a thermal voltage $V_T$. The reference voltage generator 130 adds the first and second currents I1 and I2, and generates a constant reference voltage Vref regardless of variations of a temperature and a power voltage Vdd.

The first current generator 110 includes: a current mirror 112 for receiving the power voltage Vdd, generating the first current I1, and transmitting the first current I1 to four output terminals; a PNP type bipolar transistor Q1 having its emitter connected to the first output terminal of the current mirror 112, and its base and collector connected to a ground voltage Vss; a PNP type bipolar transistor Q2 having its emitter connected to the second output terminal of the current mirror 112, and its base and collector connected to the ground voltage vss; and a resistance R1 connected between the third output terminal of the current mirror 112 and the ground voltage Vss.

In the current mirror 112, sources of PMOS transistors MP1, MP2 and MP3 are connected to the power voltage Vdd, and drains thereof are connected to sources of PMOS transistors MP8, MP9 and MP10. The common gate of the PMOS transistors MP1 and MP2 is connected to a drain of the PMOS transistor MP9. Drains of the PMOS transistors MP8 and MP9 are connected to drains of NMOS transistors MN2 and MN3. The common gate of the NMOS transistors MN2 and MN3 is connected to the drain of the NMOS transistor MN2. A PMOS transistor MP7 has its source connected to the power voltage Vdd and its drain connected to a drain of an NMOS transistor MN1. The PMOS transistor MP7 has its gate connected its drain.

The second current generator 120 includes: a current mirror 122 for receiving the power voltage Vdd, generating the second and third current I2 and I3, and transmitting the second and third currents I2 and I3 to four output terminals; a PNP type bipolar transistor Q5 having its emitter connected to the first output terminal of the current mirror 122, and its base and collector connected to the ground voltage Vss; a PNP type bipolar transistor Q4 having its emitter connected to the second output terminal of the current mirror 122, and its emitter and base connected to the ground voltage Vss; a resistance R1 connected to the third output terminal of the current mirror 122; and a bipolar transistor Q3 having its emitter connected to the resistance R1, and its base and collector connected to the ground voltage Vss.

In the current mirror 122, sources of PMOS transistors MP4, MP5 and MP6 are connected to the power voltage Vdd, and drains thereof are respectively connected to sources of PMOS transistors MP11, MP12 and MP13. The common gate of the PMOS transistors MP5 and MP6 is connected to a drain of the PMOS transistor MP12. Drains of the PMOS transistors MP12 and MP13 are respectively connected to drains of NMOS transistors MN4 and MN5. The common gate of the NMOS transistors MN4 and MN5 is connected to the drain of the NMOS transistor MN5. A PMOS transistor MP14 has its source connected to the power voltage Vdd and its drain connected to a drain of an NMOS transistor MN6. The PMOS transistor MP14 has its gate connected to its drain.

The reference voltage generator 130 includes a resistance R3 connected to the fourth output terminals of the current mirrors 112 and 122.

The operation of the bandgap reference voltage generator will now be explained.

Firstly, the channel width for each of the PMOS transistors MP4, MP11, MP6 and MP13 is set up ten times larger than that of each of the PMOS transistors MP5 and MP12. Accordingly, the current I2 flowing through the PMOS transistors MP4 and MP6 is ten times larger than the current I3 flowing through the PMOS transistor MP5.

In addition, the two PNP type bipolar transistors Q3 and Q4 are matched transistors of the same layout, and thus have the same saturated current. The channel width and current of the NMOS transistor MN5 are set up ten times larger than those of the NMOS transistor MN4.

Since a gate-source voltage $V_{GS5}$ of the NMOS transistor MN5 is equal to a gate-source voltage $V_{GS4}$ of the NMOS transistor MN4, $V_{EB2}=V_{EB1}+I3*R2$ is satisfied ($\Delta V_{EB}=V_{EB2}-V_{EB1}=V_T\ln(N)$, N=10, $V_T$ is a thermal voltage). Therefore, the following Formula 1 is obtained:

$$I3 = V_T\frac{\ln 10}{R2} \quad \text{(Formula 1)}$$

The following Formula 2 is obtained by applying the Kirchhoff principle using the resistance R1, the NMOS transistors MN2 and MN3, and the PNP type bipolar transistor Q2:

$$I1 = \frac{1}{R1}(V_{EB3} + V_{GS2} - V_{GS3}) = \frac{V_{EB3}}{R1} \quad \text{(Formula 2)}$$

Here, the NMOS transistors MN2 and MN3 are operated in a saturated region, and thus the identical current flows through the NMOS transistors MN2 and MN3. Accordingly, a gate-source voltage $V_{GS2}$ Of the NMOS transistor MN2 is equal to a gate-source voltage $V_{GS3}$ of the NMOS transistor MN3. A channel width of the PMOS transistors MP2 and MP9 is equal to that of the PMOS transistors MP3 and MP10. Thus the current flowing through the PMOS transistors MP2 and MP9 is identical to the current flowing through the PMOS transistors MP3 and MP10. As a result, it is possible to obtain the reference voltage which is not influenced by temperature variations.

As described above, all the transistors are operated in the saturated region, and thus the reference voltage Vref transmitted to the resistance R3 is represented by the following Formula 3:

$$Vref = R3(I1 + I2) = R3\frac{V_{EB3}}{R1} + R3*10*I3 = \frac{R3}{R1}V_{EB3} + \frac{R3}{R2}*10*V_T\ln 10 \quad \text{(Formula 3)}$$

As shown in Formula 3, a resistance ratio R3/R1 is proportional to the base-emitter voltage $V_{EB3}$ of the PNP type bipolar transistor Q3, a resistance ratio R3/R2 is proportional to the thermal voltage $V_T$, and thus the reference voltage Vref is decided by the resistance ratio of the resistances R1, R2 and R3. Therefore, the wanted reference voltage Vref is obtained by changing a value of the resistance R3. Here, a diode can be connected instead of the resistance R3.

In accordance with the present invention, in order to obtain the reference voltage which is not influenced by temperature variations, the whole transistors are operated in the saturated region, and the identical current is flown by using the current mirror. Moreover, the first current generating circuit 110 for generating the first current I1 proportional to the base-emitter voltage $V_{EB3}$ of the PNP type bipolar transistor Q2 by using the current mirror is separated from the second current generating circuit 120 for generating the second current I2 proportional to the thermal voltage $V_T$.

For example, reference voltage values of the following Table 1 are obtained in a period where the power voltage Vdd is 2.5V and the temperature ranges from 20 to 90° C.

TABLE 1

| Temperature | Reference voltage |
|---|---|
| 20° C. | 800 mV |
| 30° C. | 801.5 mV |
| 40° C. | 802.5 mV |
| 50° C. | 803 mV |
| 60° C. | 803 mV |
| 70° C. | 802 mV |
| 80° C. | 800.5 mV |
| 90° C. | 797 mV |

At this time, detailed values of the resistances R1, R2 and R3 are not provided.

As a result, in accordance with the present invention, the variation ratio of the reference voltage is reduced to 0.06% in a period where the power voltage Vdd is 2.5V and the temperature ranges from 20 to 90° C. In addition, the variation ratio of the reference voltage is reduced to 0.01% in a period where the power voltage Vdd ranges from 2.25V to 2.75V and the temperature is 25° C., by using the current mirror increasing the output resistance R3 and having a large swing width. Accordingly, the current mirror type bandgap reference voltage generator of the present invention can perform the stabilized operation.

Moreover, the minimum operation voltage VDDmin of the bandgap reference voltage generator is reduced to 0.8V by using the current mirror increasing the output resistance and having the large swing width. Therefore, the current mirror type bandgap reference voltage generator provides the reference voltage suitable for the DRAM of the low voltage tendency.

As the present invention may be embodied in several forms without departing from the spirit or essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within the metes and bounds of the claims, or equivalences of such metes and bounds are therefore intended to be embraced by the appended claims.

What is claimed is:

1. A current mirror type bandgap reference voltage generator responsive to variations in temperature and power voltage, the generator comprising:

a first current generating means including a first plurality of current mirrors which are cascade connected, for generating a first current proportional to a base-emitter voltage, the first current generating means having a first plurality of output terminals and outputting the first current to said first plurality of output terminals;

a second current generating means including a second plurality of current mirrors which are cascade connected, for generating a second current proportional to a thermal voltage, the second current generating means having a second plurality of output terminals and outputting the second current to said second plurality of output terminals; and a reference voltage generating means for adding the first and second currents from the first and second current generating means, and generating a constant reference voltage regardless of variations in the temperature and the power voltage, wherein at least one of the first plurality of current mirrors has a wide swing, and at least one of the second plurality of current mirrors has a wide swing.

2. The generator according to claim 1, further comprising:

a first bipolar transistor for responding to an output signal from a first output terminal of the first current generating means;

a second bipolar transistor for responding to an output signal from a second output terminal of the first current generating means, and generating the emitter-base voltage; and a first resistance device for responding to an output signal from a third output terminal of the first current generating means.

3. The generator according to claim 2, wherein the first current generating means comprises:

first to third transistors having their gates connected to each other;

fourth to seventh transistors having their gates connected to each other; and eighth to tenth transistors having their gates connected to each other, wherein sources of the first to fourth transistors are connected to the power voltage, sources of the fifth to seventh transistors are connected to drains of the first to third transistors, drains of the eighth to tenth transistors are connected to drains of the fourth to sixth transistors, a common gate of the first to third transistors is connected to the drain of the sixth transistor, a common gate of the fourth to sixth transistors is connected to the drain of the fourth transistor, a common gate of the eighth to tenth transistors is connected to a drain of the ninth transistor, a source of the eighth transistor is connected to an emitter of the second bipolar transistor, a source of the ninth transistor is connected to an emitter of the first bipolar transistor, and a source of the tenth transistor is connected to the first resistance device.

4. The generator according to claim 3, wherein the channel width of each of the second and sixth transistors is equal to the channel width of each of the third and seventh transistors.

5. The generator according to claim 2, further comprising:

a second resistance device for responding to an output signal from a first output terminal of the second current generating means;

a third bipolar transistor connected to the second resistance device, for generating the thermal voltage; and fourth and fifth bipolar transistors for responding to output signals from second and third output terminals of the second current generating means.

6. The generator according to claim 5, wherein the second current generating means comprises:

first to third transistors having their gates connected to each other;

fourth to seventh transistors having their gates connected to each other; and eighth to tenth transistors having their gates connected to each other, wherein sources of the first to fourth transistors are connected to the power voltage, sources of the fifth to seventh transistors are connected to drains of the first to third transistors, drains of the eighth to tenth transistors are connected to drains of the fourth to sixth transistors, a common gate of the first to third transistors is connected to the drain of the sixth transistor, a common gate of the fourth to sixth transistors is connected to the drain of the fourth transistor, a common gate of the eighth to tenth transistors is connected to a drain of the ninth transistor, a source of the eighth transistor is connected to the second resistance device, a source of the ninth transistor is connected to an emitter of one of the fourth and fifth bipolar transistors, and a source of the tenth transistor is connected to an emitter of another transistor of the fourth and fifth bipolar transistors.

7. The generator according to claim 6, wherein the channel width of each of the first, third, fifth and seventh transistors is ten times larger than the channel width of each of the second and sixth transistors.

8. The generator according to claim 6, wherein the channel width of the ninth transistor is ten times larger than the channel width of the tenth transistor.

9. The generator according to claim 5, wherein the reference voltage generating means comprises a third resistance device for generating the reference voltage in response to an output signal from one of the plurality of output terminals of the first current generating means and an output signal from one of the plurality of output terminals of the second current generating means.

10. The generator according to claim 9, wherein the third resistance device has a resistance ratio to the first resistance device and the second resistance device, the resistance ratio of the third resistance device to the first resistance device being proportional to the base-emitter voltage of the first bipolar transistor, the resistance ratio of the third resistance device to the second resistance device being proportional to the thermal voltage.

11. A current mirror type bandgap reference voltage generator responsive to variations in temperature and power voltage, the generator comprising:

a first current generating means for generating a first current proportional to a base-emitter voltage, the first current generating means having a first plurality of output terminals, a first current mirror for receiving the power voltage and generating the first current to the first plurality of output terminals, a first bipolar transistor for responding to an output signal from a first output terminal of the first current mirror, a second bipolar transistor for responding to an output signal from a second output terminal of the first current mirror and generating the emitter-base voltage, and a first resistance device for responding to an output signal from a third output terminal of the first current mirror;

a second current generating means for generating a second current proportional to a thermal voltage, the second current generating means having a second plurality of output terminals and a second current mirror for receiving the power voltage and generating the second current to the second plurality of output terminals; and a reference voltage generating means for adding the first and second currents from the first and second current generating means, and generating a constant reference voltage regardless of variations in the temperature and the power voltage.

12. The generator according to claim 11, wherein the first current mirror comprises:

first to third transistors having their gates connected to each other;

fourth to seventh transistors having their gates connected to each other; and eighth to tenth transistors having their gates connected to each other, wherein sources of the first to fourth transistors are connected to the power voltage, sources of the fifth to seventh transistors are connected to drains of the first to third transistors, drains of the eighth to tenth transistors are connected to drains of the fourth to sixth transistors, a common gate of the first to third transistors is connected to the drain of the sixth transistor, a common gate of the fourth to sixth transistors is connected to the drain of the fourth transistor, a common gate of the eighth to tenth transistors is connected to a drain of the ninth transistor, a source of the eighth transistor is connected to an emitter of the second bipolar transistor, a source of the ninth transistor is connected to an emitter of the first bipolar transistor, and a source of the tenth transistor is connected to the first resistance device.

13. The generator according to claim 12, wherein the channel width of each of the second and sixth transistors is equal to the channel width of each of the third and seventh transistors.

14. The generator according to claim 11, wherein the second current generating means further comprises:

a second resistance device for responding to an output signal from a first output terminal of the second current mirror;

a third bipolar transistor connected to the second resistance device, for generating the thermal voltage; and fourth and fifth bipolar transistors for responding to output signals from second and third output terminals of the second current mirror.

15. The generator according to claim 14, wherein the second current mirror comprises:

first to third transistors having their gates connected to each other;

fourth to seventh transistors having their gates connected to each other; and eighth to tenth transistors having their gates connected to each other, wherein sources of the first to fourth transistors are connected to the power voltage, sources of the fifth to seventh transistors are connected to drains of the first to third transistors, drains of the eighth to tenth transistors are connected to drains of the fourth to sixth transistors, a common gate of the first to third transistors is connected to the drain of the sixth transistor, a common gate of the fourth to sixth transistors is connected to the drain of the fourth transistor, a common gate of the eighth to tenth transistors is connected to a drain of the ninth transistor, a source of the eighth transistor is connected to the second resistance device, a source of the ninth transistor is connected to an emitter of one of the fourth and fifth bipolar transistors, and a source of the tenth transistor is connected to an emitter of another transistor of the fourth and fifth bipolar transistors.

16. The generator according to claim 15, wherein a channel width of each of the first, third, fifth and seventh transistors is ten times larger than a channel width of each of the second and sixth transistors.

17. The generator according to claim 15, wherein a channel width of the ninth transistor is ten times larger than a channel width of the tenth transistor.

18. The generator according to claim 14, wherein the reference voltage generating means comprises a third resistance device for generating the reference voltage in response to an output signal from one of the plurality of output terminals of the first current generating means and an output signal from one of the plurality of output terminals of the second current generating means.

19. A current mirror type bandgap reference voltage generator responsive to variations in temperature and power voltage, the generator comprising:

a first current generating means for generating a first current proportional to a base-emitter voltage, the first current generating means having a first plurality of output terminals, and a first current mirror for receiving the power voltage and generating the first current to the first plurality of output terminals;

a second current generating means for generating a second current proportional to a thermal voltage, the second current generating means having a second plurality of output terminals, a second current mirror for receiving the power voltage and generating the second current to the second plurality of output terminals, a resistance device for responding to an output signal from a first output terminal of the second current mirror, a first bipolar transistor connected to the resistance device for generating the thermal voltage, and second and third bipolar transistors for responding to output signals from second and third output terminals of the second current mirror; and a reference voltage generating means for adding the first and second currents from the first and second current generating means, and generating a constant reference voltage regardless of variations in the temperature and the power voltage.

20. The generator according to claim 19, wherein the second current mirror comprises:

first to third transistors having their gates connected to each other;

fourth to seventh transistors having their gates connected to each other; and eighth to tenth transistors having their gates connected to each other, wherein sources of the first to fourth transistors are connected to the power voltage, sources of the fifth to seventh transistors are connected to drains of the first to third transistors, drains of the eighth to tenth transistors are connected to drains of the fourth to sixth transistors, a common gate of the first to third transistors is connected to the drain of the sixth transistor, a common gate of the fourth to sixth transistors is connected to the drain of the fourth transistor, a common gate of the eighth to tenth transistors is connected to a drain of the ninth transistor, a source of the eighth transistor is connected to the resistance device, a source of the ninth transistor is connected to an emitter of one of the second and third bipolar transistors, and a source of the tenth transistor is connected to an emitter of another transistor of the second and third bipolar transistors.

* * * * *